US011197589B2

(12) United States Patent
Cheung et al.

(10) Patent No.: US 11,197,589 B2
(45) Date of Patent: Dec. 14, 2021

(54) MOISTURE RETAINING POCKET TOWEL

(71) Applicant: Man Kin Cheung, Hong Kong (HK)

(72) Inventors: Man Kin Cheung, Hong Kong (HK); Man Ngai Manfred Cheung, Hong Kong (HK)

( * ) Notice: Subject to any disclaimer, the term of this patent is extended or adjusted under 35 U.S.C. 154(b) by 313 days.

(21) Appl. No.: 16/593,219

(22) Filed: Oct. 4, 2019

(65) Prior Publication Data

US 2021/0100408 A1 Apr. 8, 2021

(51) Int. Cl.

| | |
|---|---|
| ***A47K 10/02*** | (2006.01) |
| ***A45C 13/10*** | (2006.01) |
| ***A45F 5/00*** | (2006.01) |
| ***A41B 15/00*** | (2006.01) |

(52) U.S. Cl.

CPC ..... *A47K 10/025* (2013.01); *A45C 13/1069* (2013.01); *A45F 5/00* (2013.01); *A47K 10/02* (2013.01); *A41B 15/00* (2013.01)

(58) Field of Classification Search

CPC .. A47K 10/025; A47K 10/02; A45C 13/1069; A45F 5/00; A41B 15/00

USPC ..... 34/90; 15/209.1

See application file for complete search history.

(56) References Cited

U.S. PATENT DOCUMENTS

| | | | | |
|---|---|---|---|---|
| 4,867,216 | A * | 9/1989 | McKee | B60J 11/00 150/166 |
| 7,819,277 | B2 * | 10/2010 | Hanson | A45F 5/10 220/737 |
| 8,136,695 | B2 * | 3/2012 | De Jong | A47K 10/28 221/11 |
| 9,259,041 | B1 * | 2/2016 | Purcaro | A45F 3/04 |
| 10,021,227 | B2 * | 7/2018 | Gander | A45F 5/00 |
| 10,322,325 | B2 * | 6/2019 | Farina | A63B 47/04 |
| 2009/0277935 | A1 * | 11/2009 | Hanson | A45F 5/10 224/148.4 |
| 2015/0173432 | A1 * | 6/2015 | McCoy | A41D 13/0056 62/259.3 |
| 2018/0044911 | A1 * | 2/2018 | Wolf | H02G 3/22 |
| 2021/0100408 | A1 * | 4/2021 | Cheung | A47K 10/025 |

FOREIGN PATENT DOCUMENTS

| | | | | |
|---|---|---|---|---|
| CN | 107319994 | A | 11/2017 | |
| EP | 3256656 | B1 * | 4/2019 | H02G 3/22 |
| WO | WO-2021064675 | A1 * | 4/2021 | A45F 5/00 |

* cited by examiner

*Primary Examiner* — Stephen M Gravini

(74) *Attorney, Agent, or Firm* — Novoclaims Patent Services LLC

(57) ABSTRACT

A moisture retaining pocket towel includes a water retaining mechanism having an absorbing layer, a base layer and an outer layer. The water retaining mechanism is divided into a first half portion and a second half portion which is capable to be folded in half to move between a folding position and an actuating position. The moisture retaining pocket towel also has an outer rim being jointed by an upper portion rim and a lower portion rim encasing around an outer edge of the water retaining mechanism for retaining moisture. In folding position, the water retaining mechanism is folded in half and the exposure of the absorbing layer to the outside environment is minimized for retaining moisture. In addition, magnetic elements are used to retain the folding position.

20 Claims, 19 Drawing Sheets

MOISTURE RETAINING POCKET TOWEL

BACKGROUND OF THE PRESENT INVENTION

Field of Invention

The present invention relates to towel, and more particularly to a moisture retaining pocket towel for various cleaning purposes. When not in used, the towel of the present invention may also be folded for storage in pockets or bags which can retain moisture effectively until next use.

Description of Related Arts

Conventional cleaning wipes such as wet tissues are disposable are non-environment friendly. It is rather costly to the user as well since they are disposable. Another popular conventional cleaning wipes are towels or handkerchiefs. Towels or handkerchiefs are reusable item; however, it is typically used when they are dry. If the user soaks the towels with water for use, the soaked towels are inconvenient for storage as it may wet the user's pockets or bags. Wet towels or handkerchiefs are not hygienic since there are no protections for storing and encasing the towels or handkerchiefs. Another disadvantage is that the soaked towel will lose its moisture overtime typically in a few hours. And when the user wants to use it for cleaning, water source may not be accessible near the user.

There are existing multi-layers towel or handkerchief designs which typically have a water absorbing layer and a water resistance layer stacked together. The user can soak the water absorbing layer side for cleaning and wiping purposes. The water resistance layer side can be kept dry and can also help to reduce moisture from losing at least on one side of the water absorbing layer since they are stacked together back to back. For storage, these kinds of towel or handkerchief are inconvenient because a full side of the absorbing layer is wet. The user may fold the towel or handkerchief in half or in quarters and then store them in pockets or bags. However, it is easy for moisture to leak through the edge of the water absorbing layer. This is a problem if the user wants to store such soaked article inside his trouser pockets or bags. In addition, these conventional towels or handkerchiefs do not have a mechanism to retain the folding position. When such towel or handkerchief is unfolded and opened, moisture may not be retained effectively.

Another common use of the towel or handkerchief is for personal hygiene such as wiping sweat off his face or blowing his nose. The user may fold the used towel or handkerchief containing sweats and moisture and store in his pocket or bag. However, there are two major problems. The first one is that sweats can still leak which is unhygienic. The second problem is that if a multi-layers towel or handkerchief is used in the case here, the water resistance layer often has low breathability and does not allow moisture or air to travel through the layers. This causes a hygiene problem as well. It would be more hygienic for outside air to get to the used towel or handkerchief especially the layer trapping the sweats for example. In view of this, a delicate balance for this application is required which the towel or handkerchief can seal and trap moisture from leaking and yet it allows breathability for air to have access to the layers.

As one may see from the above, there are problems with these conventional wet tissues, hygienic wipes, towels or handkerchiefs. Thus, there is a need to invent a non-disposable, moisture retaining pocket towel which can overcome the above mentioned problems.

SUMMARY OF THE PRESENT INVENTION

The present invention provides a moisture retaining pocket towel which is foldable for wet cleaning purpose and can be dryly stored while in a folding position.

In one aspect of the present invention, it provides a moisture retaining pocket towel, comprising:

a water retaining mechanism comprising a base layer having a front surface and a rear surface, an absorbing layer provided on the front surface of the base layer, and an outer layer provided on the rear surface of the base layer, wherein the water retaining mechanism is divided into a first half portion and a second half portion and is foldable in half to move between a folding position and an actuating position;

an outer rim divided into an upper portion rim and a lower portion rim encasing around an outer edge of the water retaining mechanism forming a water retaining peripheral; and at least one pair of magnetic elements in opposite polarity provided at the outer rim;

wherein in the folding position, the water retaining mechanism is folded in half and the exposure of the absorbing layer to the outside environment is minimized for retaining moisture, the magnetic elements pair with each other to retain the folding position, wherein in the actuating position, the magnetic elements unpair with each other such that the absorbing layer is unfolded for usage.

This summary presented above is provided merely to introduce certain concepts and not to identify any key or essential features of the claimed subject matter.

DETAILED DESCRIPTION OF THE PREFERRED EMBODIMENT

The following detailed description of the preferred embodiment is the preferred mode of carrying out the invention. The description is not to be taken in any limiting sense. It is presented for the purpose of illustrating the general principles of the present invention.

Figure 1:
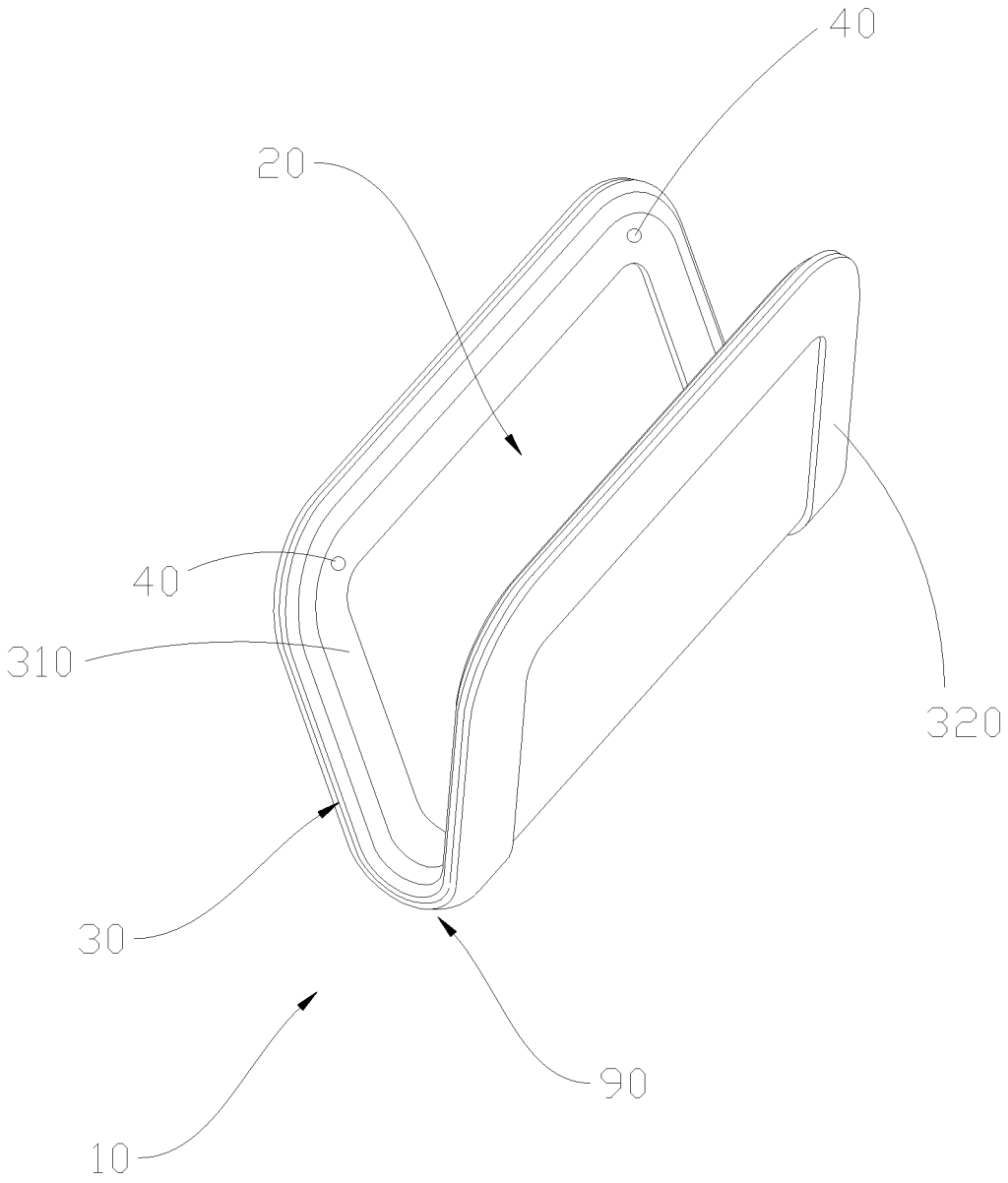
FIG. 1 is a perspective view of the moisture retaining pocket towel according to the preferred embodiment of the present invention.

Referring to FIG. 1 of the drawings, a perspective view of the moisture retaining pocket towel 10 according to the preferred embodiment of the present invention is illustrated. Broadly, the moisture retaining pocket towel 10 comprises a water retaining mechanism 20, an outer rim 30, and at least one pair of magnetic elements 40. The outer rim 30 is further divided into an upper portion rim 310 and a lower portion rim 320. The outer rim 30 encases around an outer edge of the water retaining mechanism 20 forming a water retaining peripheral 90. The pair of magnetic elements 40 are provided beneath the upper portion rim 310.

Figure 2:
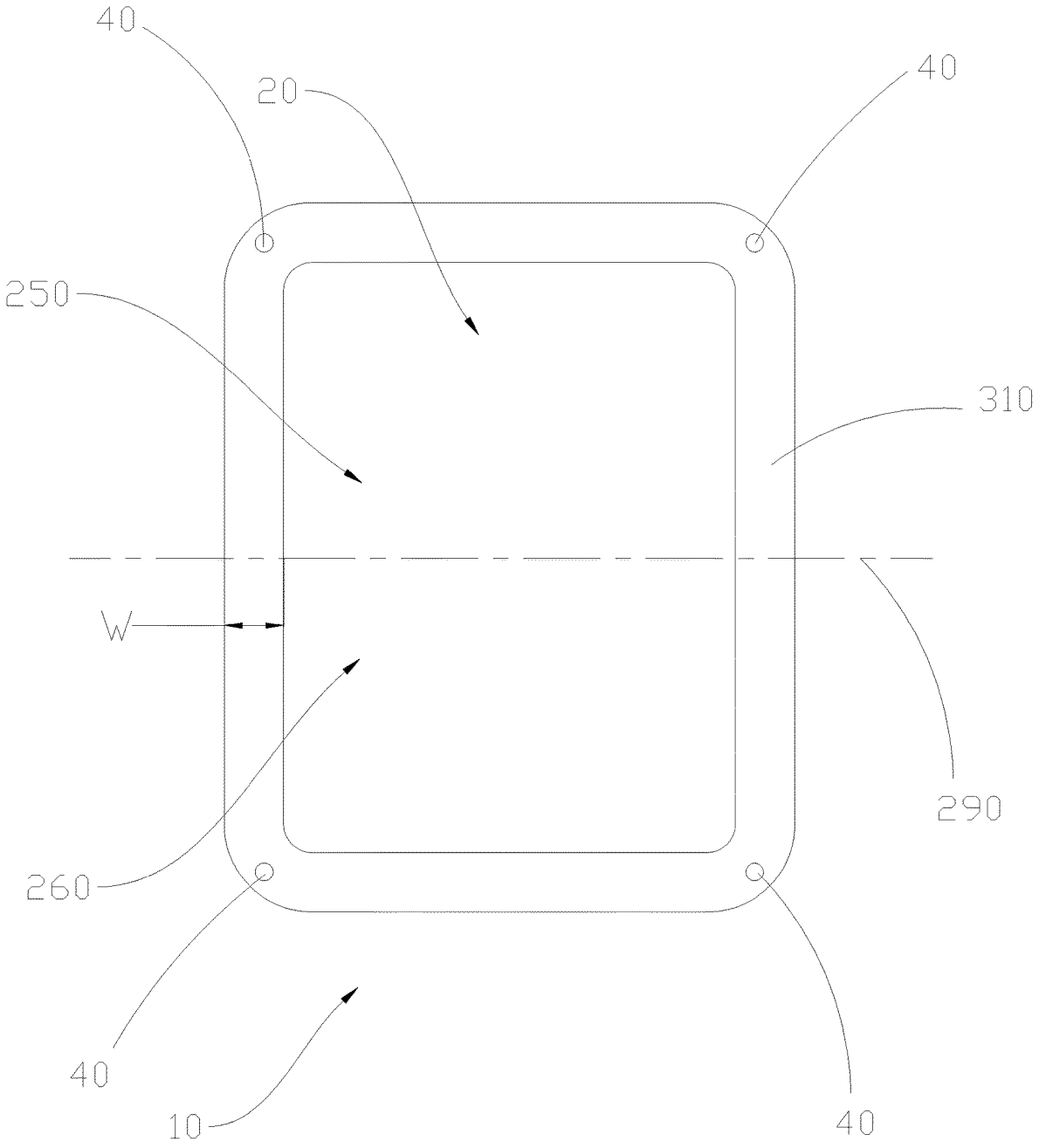
FIG. 2 is top view of the moisture retaining pocket towel in actuating position according to the preferred embodiment of the present invention.
Figure 3:
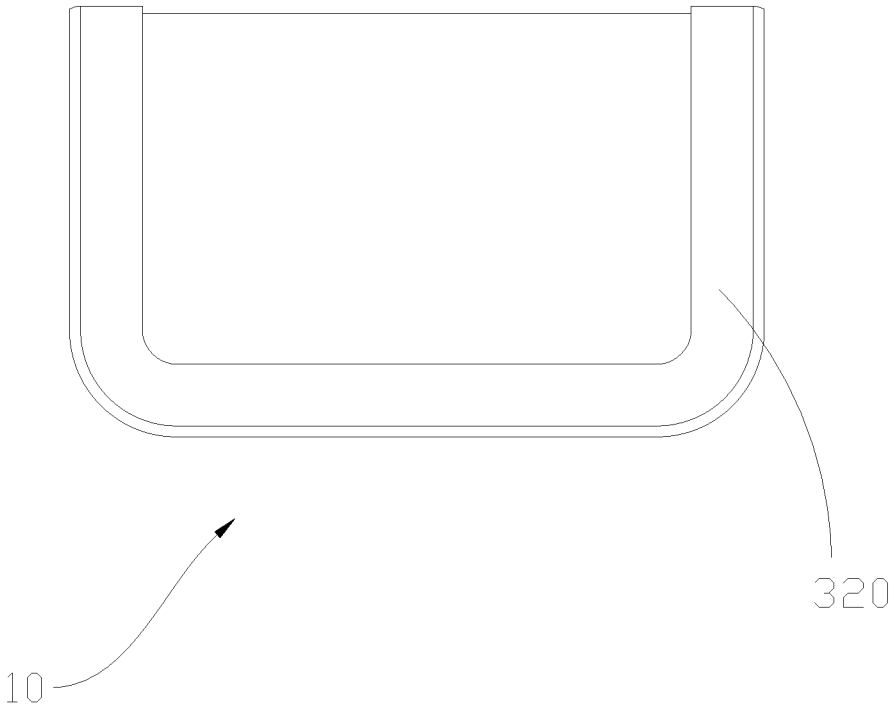
FIG. 3 is top view of the moisture retaining pocket towel in folding position according to the preferred embodiment of the present invention.

Referring to FIGS. 2 and 3 of the drawings, top views of the moisture retaining pocket towel 10 in actuating position and folding position are illustrated respectively according to the preferred embodiment of the present invention. Referring to FIG. 2 of the drawings, the water retaining mechanism 20 may be divided into a first half portion 250 and a second half portion 260 by a centerline 290. The water retaining mechanism 20 is foldable in half and is capable to move between a folding position and to unfold into an actuating position. The side to be folded inwardly is the side with the upper portion rim 310. Referring to FIG. 3 of the drawings, when the first half portion 250 is folded onto the second half portion 260 in close contact with each other, the water retaining mechanism 20 is in folding position. As soon as either the upper portion 250 or lower portion 260 leaves contact with each other, the water retaining mechanism 20 is in actuating position. According to the preferring embodiment of the present invention, the water retaining mechanism 20 can unfold as a flat sheet as shown in FIG. 2 of the drawings.

Referring to FIG. 2 of the drawings, two pairs of magnetic elements 40 are provided at the outer rim 30 for illustration purpose. Specifically, according to the preferred embodiment of the present invention, the two pairs of magnetic elements 40 are provided beneath the upper portion rim 310. Each pair of magnetic elements 40 provides an attracting force to each other as they are in opposite polarity when they are in proximity to each other. When the water retaining mechanism 20 is in folding position, magnetic elements 40 placed at the upper portion rim 310 would offer the most direct attractive forces between each pair of magnet element 40. Referring to FIG. 2 of the drawings, the pair of the magnetic elements 40 are circular in shapes. Since the first half portion 250 must be in symmetry with the second half portion 260, the locations for each pair of magnetic elements 40 must be also in symmetry manner. As an alternative, the shapes of the magnetic elements 40 may also be rectangular or irregular in shapes.

Figure 4:
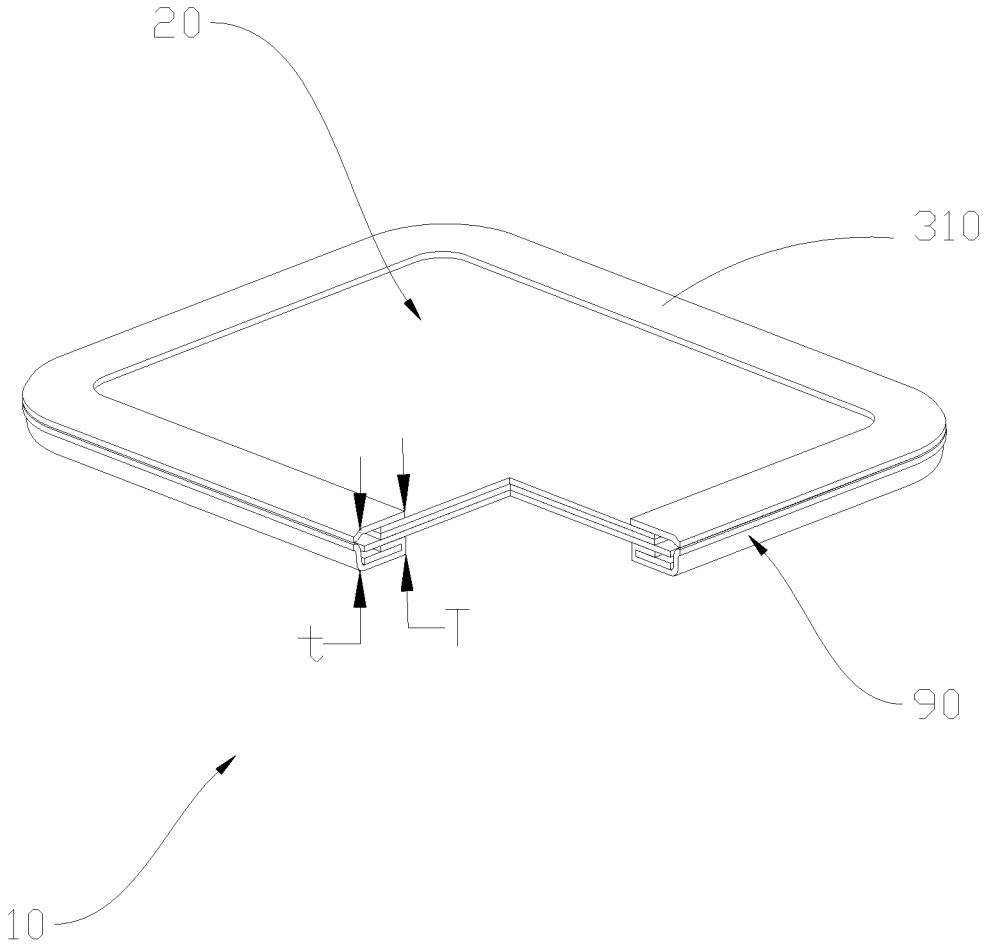
FIG. 4 is a perspective view of the moisture retaining pocket towel in actuating position with a cut away section for illustrative purpose according to the preferred embodiment of the present invention.
Figure 5:
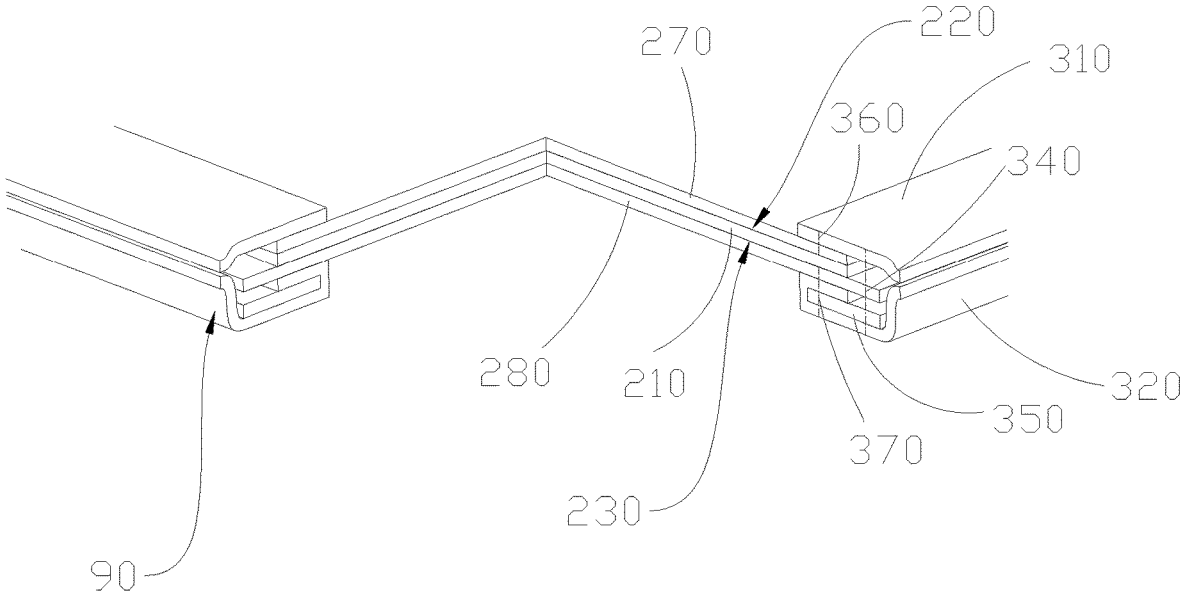
FIG. 5 is a magnified perspective view of the cut away section from FIG. 4 for illustrative purpose according to the preferred embodiment of the present invention.

Referring to FIG. 4 of the drawings, a perspective view of the moisture retaining pocket towel 10 in actuating position with a cut away section for illustrative purpose according to the preferred embodiment is shown. FIG. 5 of the drawings is a magnified perspective view of the cut away section from FIG. 4 according to the preferred embodiment of the present invention. As shown in FIG. 5 of the drawings, the water retaining mechanism 20 comprises a base layer 210 which has a front surface 220 facing upward and a rear surface 230 facing downward. The rear surface 230 is on the opposite side of the front surface 220. In addition, the water retaining mechanism 20 further comprises an absorbing layer 270 provided on the front surface 220 of the base layer 210. The absorbing layer 270 is glued onto the base layer 210. The water retaining mechanism 20 further comprises an outer layer 280 provided on the rear surface 230 of the base layer 210. The outer layer 280 is glued onto the base layer 210. According to the preferred embodiment of the present invention, the outer rim 30 which is divided into an upper portion rim 310 and a lower portion rim 320 encases around the outer edge of the water retaining mechanism 20 forming the water retaining peripheral 90. The outer edge is the side of the different layers stacked together. In addition, the lower portion rim 320 wraps around an auxiliary waterproof layer 350 which is provided in between the lower portion rim 320 as shown in FIG. 5 of the drawings.

According to the preferred embodiment of the present invention, the absorbing layer 270 is made of textile which may absorb water and moisture efficiently. The choice of textile may be selected according to the target to be cleaned. A higher quality of cloth is preferred if it is for cleaning the facial area of the human body. The base layer 210 is made of pearl cotton. Pearl cotton material does not absorb water and it forms a foundation for the water retaining mechanism 20 such that it can be folded in half easily and yet it can provide a firm support to the absorbing layer 270. The thickness for the base layer 210 is about 2-3 mm which is an optimal thickness in order for the pearl cotton material to provide a firm support. The material choice of the base layer 210 can also be replaced by different textile ranging from being completely waterproof to moderately waterproof in order to adjust the level of breathability and moisture retaining. Preferably, the outer layer 280 is made of soft PU leather. The material choice of the outer layer 280 can also be replaced by different textile ranging from being completely waterproof to moderately waterproof in order to adjust the level of breathability and moisture retaining effectiveness. According to the preferred embodiment of the present invention, the outer rim 30 is made from soft PU leather also. The choice of this material offers overall protection and durability to the moisture retaining pocket towel 10. Soft PU leather also offers better grip for the user's hand as the invention is designed best for operation by a user's hand. The auxiliary waterproof layer 350 is made of leather paper which is capable to act as an extra layer to block moisture from escaping to the outer layer 280. It is a cost effective choice of material and it can be replaced by other waterproof material as well.

Furthermore, according to FIG. 5 of the drawings, the outer rim 30 is reinforced around the outer edge of the water retaining mechanism 20 by an upper inner stitching 360, a lower inner stitching 370 and an outer stitching 340. The upper inner stitching 360 joins and passes through the upper portion rim 310 and the absorbing layer 270. The lower inner stitching 370 joins and passes through the outer layer 280, the auxiliary waterproof layer 350 and the lower portion rim 320. It is specifically designed that the upper inner stitching 360 and the lower inner stitching 370 will not pass through the base layer as the purpose of the base layer 210 is to retain water and moisture within the absorbing layer 270. Water may run along the stitching as it creates space and pathways for them to travel through. The outer stitching 340 is provided at the location further away from the upper inner stitching 360 or the lower inner stitching 370 near the outer edge of the water retaining mechanism 20. The outer stitching 340 joins and passes through the upper portion rim 310, the outer layer 280, the auxiliary waterproof layer 350 and the lower portion rim 320. After the present invention is soaked, most of the moisture and water are kept within the absorbing layer 270. A small amount of water from the absorbing layer 270 may still travel on the surface of the base layer 210 and leak through the outer stitching 340 toward the lower portion rim 320. Therefore, the auxiliary waterproof layer 350 is placed there to catch these leaks to minimize the chance for water to get to the user. In addition, adhesive glues may also be added to join the upper portion rim 310 and the lower portion rim 320 to seal the outer rim 30 such that moisture and water cannot be leaked to the outside.

Figure 6:
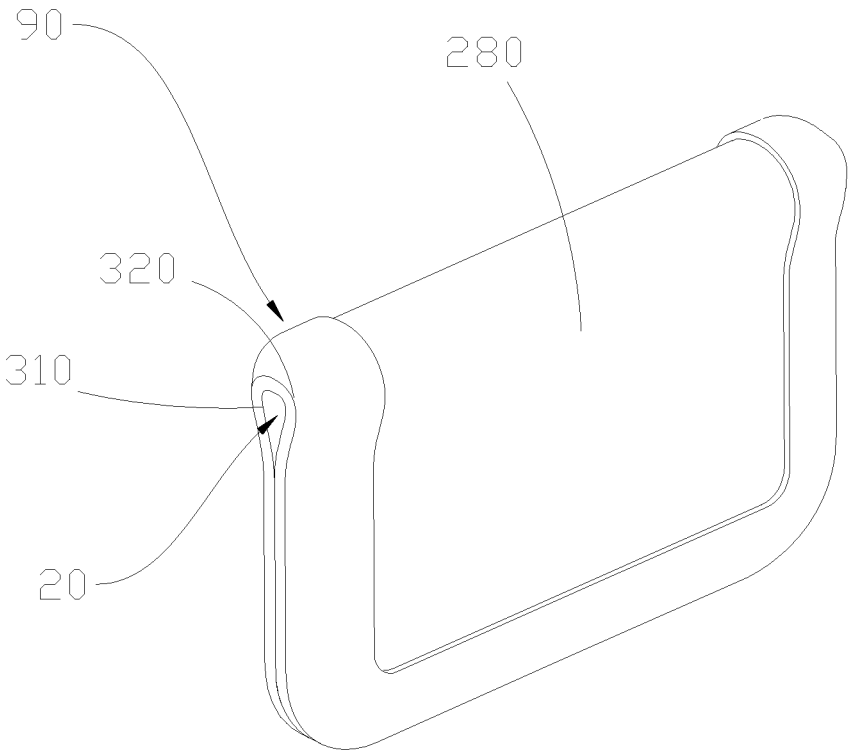
FIG. 6 is a perspective view of the moisture retaining pocket towel in folding position according to the preferred embodiment of the present invention.
Figure 7:
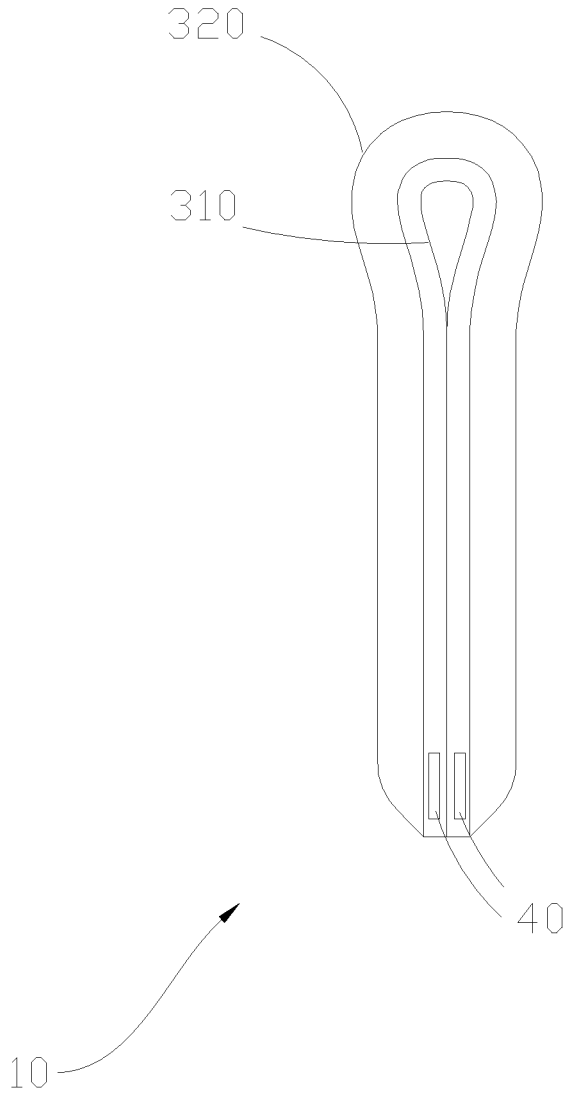
FIG. 7 is a side view of the moisture retaining pocket towel in folding position according to the preferred embodiment of the present invention.

Referring to FIG. 6 and FIG. 7 of the drawings, a perspective view and a side view of the moisture retaining pocket towel 10 in folding position according to the preferred embodiment of the present invention are illustrated. Once the moisture retaining pocket towel 10 is in folding position, the magnetic elements 40 will retain the folding position as the pair of magnets will attract magnetically in opposite polarity with each other. The exposure of the absorbing layer 270 to the outside environment will then be minimized for retaining moisture purpose. However, moisture and water may still leak through along the edge area where the first half portion 250 folds onto the second half portion 260. Once the moisture retaining pocket towel 10 is in folding position, the water retaining peripheral 90 plays an important role to seal this edge area to prevent moisture and water to leak from the absorbing layer 270. It also reduces the evaporation rate of the moisture from the absorbing layer 270 since the exposure to air is minimized in the folding position. The outer rim 30 is made of material with predetermined softness. The water retaining peripheral 90 has a predetermined thickness and width. For clarity, the width measure of the water retaining peripheral 90 is indicated as W in FIG. 2 of the drawings. The thickness measures of the water retaining peripheral 90 are indicated as T and t in FIG. 4 of the drawings. These predetermined softness, thickness and width are optimized such that the water retaining mechanism 20 can be folded in half while retaining moisture from leaking.

The preferred material choice of the outer rim 30 is a soft PU leather. If the material choice for the outer rim 30 is much harder than a soft PU leather, it would be difficult to even fold the outer rim 30 at even a small angle. Preferably, as show in FIG. 4 of the drawings, the thickness T of the water retaining peripheral 90 is 5-7 mm. If the thickness exceeds over the mentioned preferred value of 5-7 mm, it would be difficult for the water retaining mechanism 20 to arrive at the folding position because the non-compressive thicker upper portion rim 310 near the centerline 290 naturally pushes to unfold itself. Even with the help of the pair of magnetic elements 40, the magnetic force may not be able to retain the folding position successfully. In addition, according to FIG. 6 and FIG. 7 of the drawings, there will always be a gap near the centerline 290 in folding position since the material of the upper portion rim 310 is non-compressive. In view of this, the thickness T of 5-7 mm for the water retaining peripheral 90 is chosen carefully such that the thickness of the curled up material of the upper portion rim 310 near the centerline 290 may fill up as much gap as possible to stop water or moisture from leaking and evaporating from exposure. According to FIG. 4 of the drawings, the thickness t is about 1 mm. This thickness t value is smaller than thickness T because there are fewer layers. Therefore, the water retaining peripheral 90 will form a triangle shape with the thickness T being thicker and gradually becoming thinner near the outer edge for the stitching design purposes. Preferably, the width W of the water retaining peripheral 90 is 10-12 mm. The preferred width W of 10-12 mm is chosen carefully also in view that the exposed area of the absorbing layer 270 for cleaning purposes must be maximized while the outer rim 30 can still perform its function to minimize the water leak or moisture evaporating from the outer edge of the water retaining mechanism 20. The width W of 10-12 mm is chosen carefully in considerations of the overall size of the pocket towel and in consideration of the stitching. As mentioned above, because a small amount of water from the absorbing layer 270 may still travel on the surface of the base layer 210 and leak through the outer stitching 340 toward the lower portion rim 320, it is better to separate the outer stitching 340 as far away from the upper inner stitching 360 or the lower inner stitching 370 as possible to maximize the water retaining function. However, to compromise for the exposed area of the absorbing layer 270 for cleaning purposes and in consideration for the overall size of the pocket towel for a human user to use, the preferred embodiment of the present invention found the best value to arrive at the width of 10-12 mm for the outer rim 30. If this width is increased, then either the exposed area of the absorbing layer 270 will be reduced, or the overall size of the moisture retaining pocket towel 10 will be increased which may not fitted comfortably in a human hand. Therefore, there is a balance in choosing the thickness, width and material softness for water retaining peripheral 90.

Figure 8:
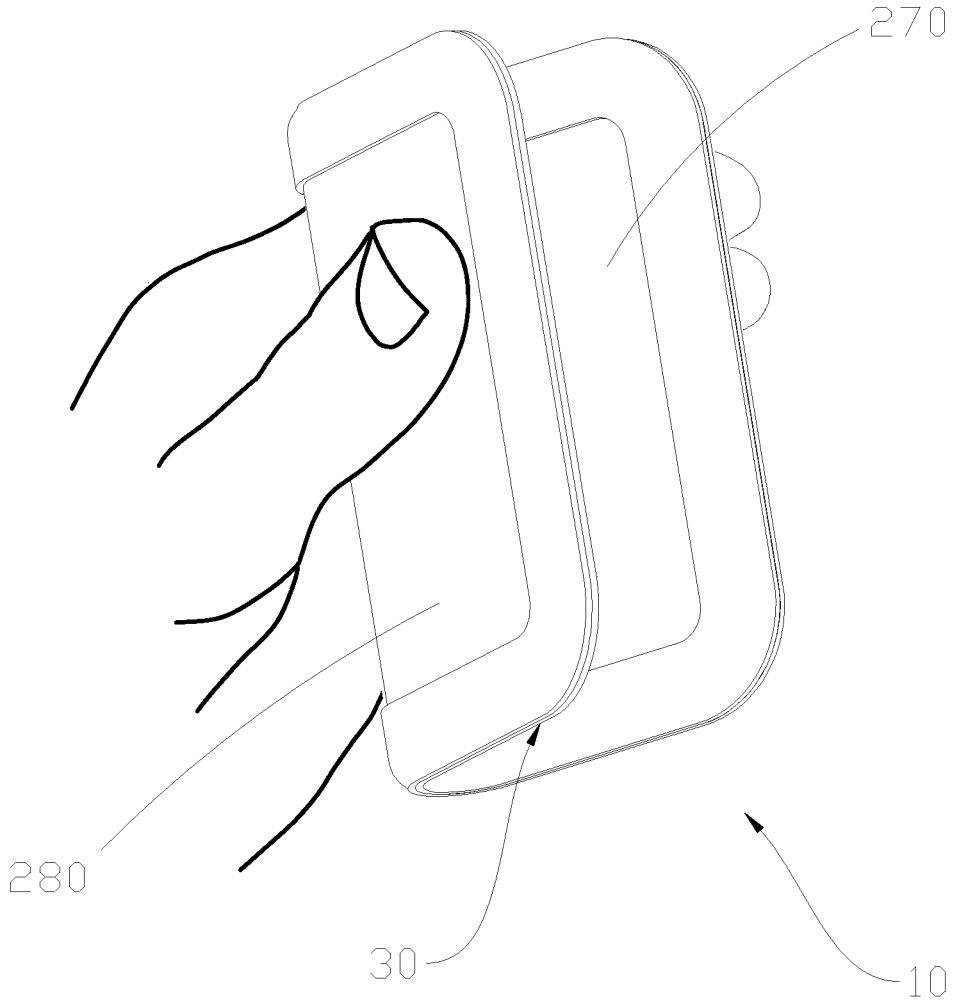
FIG. 8 is a perspective view of the moisture retaining pocket towel in actuating position while being operated by a user according to the preferred embodiment of the present invention.

FIG. 8 of the drawings illustrates a perspective view of the moisture retaining pocket towel 10 in actuating position while being operated by a user according to the preferred embodiment of the present invention. Before using the moisture retaining pocket towel 10, the user can soak the absorbing layer 270 with water. Afterward, the user can dry the excessive moisture and water off the outer rim 30 and the outer layer 280. When in folding position, the moisture retaining pocket towel 10 can be dryly stored inside the user's bag or trouser pocket. When the user wants to use it, he may then unpair the magnetic elements 40 to unfold the moisture retaining pocket towel 10 to the actuating position. As seen from FIG. 8 of the drawings, the present invention is designed to be best fitted by a user's hand. The user may securely hold on the moisture retaining pocket towel 10 by his thumb, palm and the other four fingers so that the unfolded exposed absorbing layer 270 which is a moisturized cloth can be applied on objects for cleaning purposes. The user can hold on to the moisture retaining pocket towel 10 with one hand in a stationary position while the other hand holds the object to be cleaned and engage the moisture retaining pocket towel 10 to clean it in a cleaning motion. Overall, the water retaining mechanism 20 is soft and flexible enough to be applied on articles with various shape just like a regular cleaning cloth. Alternatively, the user can directly apply the moisture retaining pocket towel 10 in a cleaning motion onto the object to be cleaned. After cleaning, the user may then simply fold the moisture retaining pocket towel 10 into the folding position for storage. It is also important to point out that the outer rim 30 and the water retaining mechanism 20 are reinforced together by stitching because it is a practical and efficient way to securely hold multiple layers of material together. While the moisture retaining pocket towel 10 is in use by the user, the wiping and cleaning movement by the user's hand will create a lot of stress on the layers of materials. In view of this, even though the upper inner stitching 360, the lower inner stitching 370 and the outer stitching 340 may create pathways for moisture and water leaks, they are the most cost-efficient way to securely hold multiple layers together. If no stitching is used in the present invention, it is very likely that such design will not be as durable as the present invention. Therefore, the present invention has found the perfect balance between reliability in performance and durability for long term usage. It is also worth to mentioned that the moisture retaining pocket towel 10 may be made in a bigger size for different applications. For example, the absorbing layer 270 may have a bigger size which offer a larger cleaning surface area for different applications or for different user sizes preference.

Figure 9:
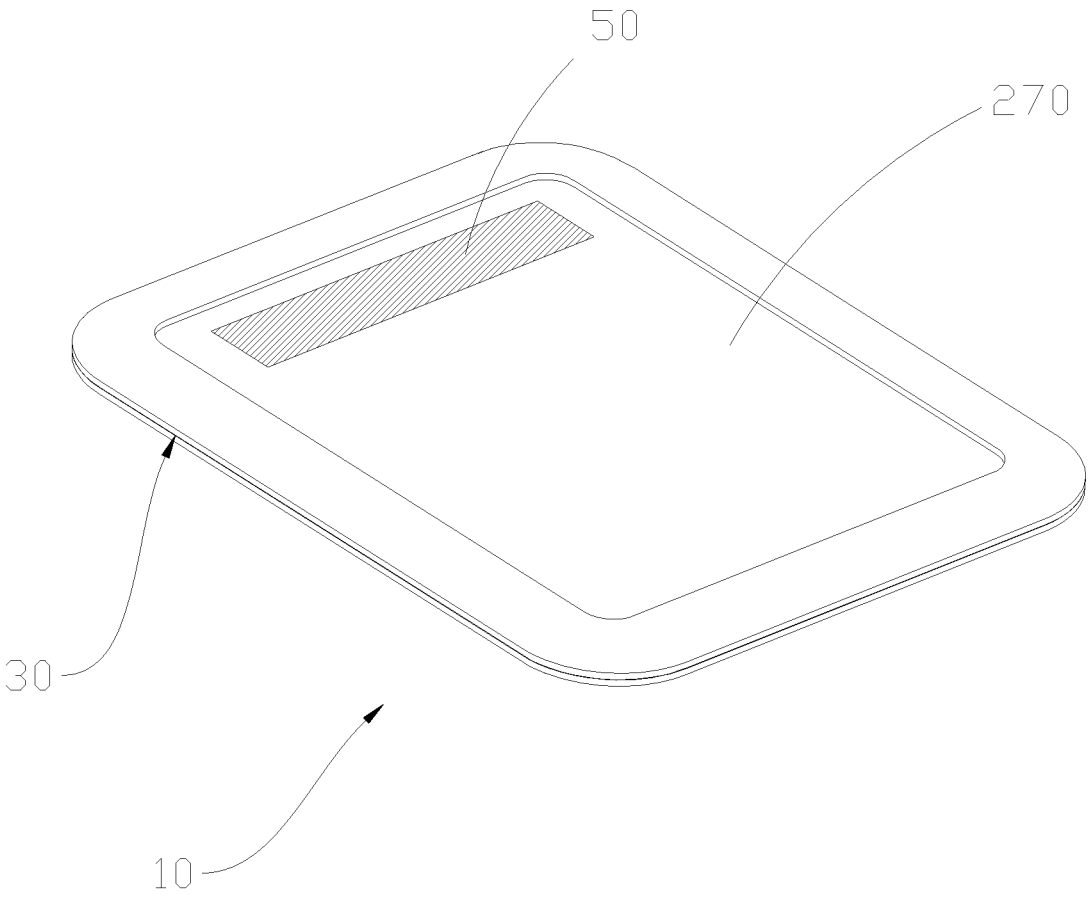
FIG. 9 is another perspective view of the moisture retaining pocket towel in actuating position illustrating the scrubbing mesh.

FIG. 9 of the drawings illustrates another perspective view of the moisture retaining pocket towel 10 in actuating position. A small portion of the absorbing layer 270 comprises a scrubbing mesh 50 which can be used to clean hard and durable dirt off the articles to be cleaned. The scrubbing mesh 50 is a small scrubbing surface which protrudes from the absorbing layer 270.

The advantage of the present invention is that it is a reusable wet cleaning pocket towel. When it is in folding position, the absorbing layer 270 can maintain the moisture typically throughout a whole day since it is exposure of the absorbing layer 270 to the outside environment when not in use is minimized. In addition, once the moisture retaining pocket towel 10 is in folding position, it can be conveniently and dryly stored inside the user's bag or trouser pocket to be ready for the next use. It is also worth to point out the uniqueness of the present invention choosing to use the magnetic elements 40 for retaining the folding position. Although magnets are common materials used in apparatus or pocket with opening and closing functions, the present invention uses magnets elements 40 to retain the folding position while keeping moisture efficiently retained. If one substitute the magnets with a conventional zipper, it is very easy for moisture and water to leak through the zipper. If the towel is simply folded in half and then store in pockets or bags, it is easy for moisture and water to leak through the edge area of the absorbing layer 270. There are no existing products which can retain moisture as well as the present invention by using magnets. The present invention can be used like a normal towel in which it can be fully unfolded all the way as a flat sheet for wiping and cleaning purposes.

Figure 10:
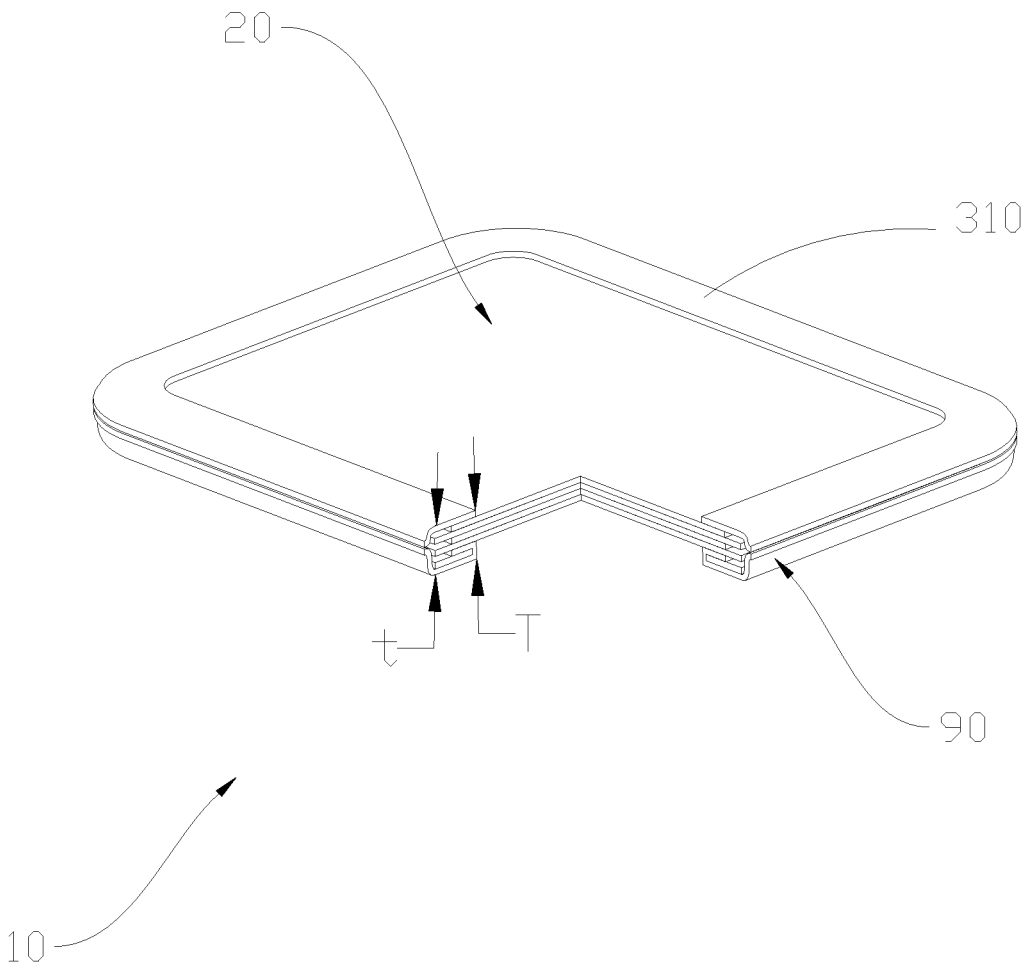
FIG. 10 is a perspective view of the moisture retaining pocket towel in actuating position with a cut away section for illustrative purpose according to an alternative of the preferred embodiment of the present invention.
Figure 11:
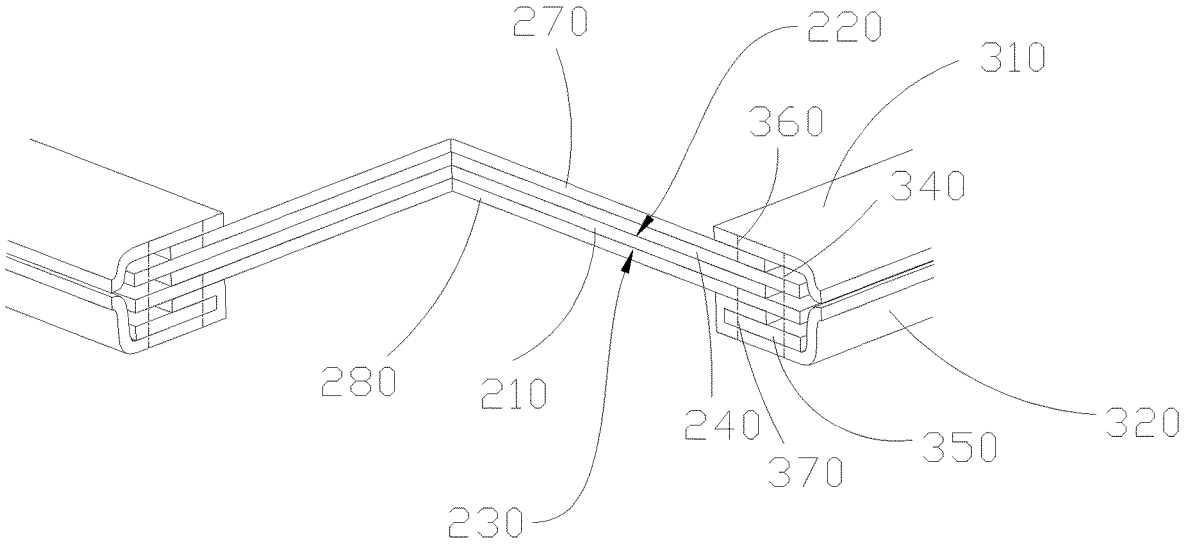
FIG. 11 is a magnified perspective view of the cut away section from FIG. 10 for illustrative purpose according to an alternative of the preferred embodiment of the present invention.

As an alternative to the preferred embodiment of the present invention, as shown in FIG. 10 and FIG. 11 of the drawings, the water retaining mechanism 20 further comprises a waterproof layer 240 provided on the front surface 220 of the base layer 210. The waterproof layer 240 is glued onto the base layer 210. All the elements and functions of this alternative remain the same as mentioned above. The purpose for adding the waterproof layer 240 as an alternative is for enhancing the water retaining ability of the water retaining mechanism 20.

Referring to FIG. 11 of the drawings, the surface area of the waterproof layer 240 is larger than the surface area of the absorbing layer 270. According to this alternative, the upper inner stitching 360 joins and passes through the upper portion rim 310 and the absorbing layer 270. The lower inner stitching 370 joins and passes through the outer layer 280, the auxiliary waterproof layer 350 and the lower portion rim 320. It is specifically designed that the upper inner stitching 360 and the lower inner stitching 370 will not pass through the base layer 210 or the waterproof layer 240 as the purpose of the waterproof layer 240 and the base layer 210 is to retain water and moisture within the absorbing layer 270. Water may run along the stitching as it creates space and pathways for them to travel through. The outer stitching 340 is provided at the location further away from the upper inner stitching 360 or the lower inner stitching 370 near the outer edge of the water retaining mechanism 20. The outer stitching 340 joins and passes through the upper portion rim 310, the waterproof layer 240, the outer layer 280, the auxiliary waterproof layer 350 and the lower portion rim 320. Since the surface area of the waterproof layer 240 is larger than the surface area of the absorbing layer 270, the outer stitching 340 will not pass through the absorbing layer 270 in order to minimize the chance for water to pass through to the other layers through the outer stitching 340. After the present invention is soaked, most of the moisture and water are kept within the absorbing layer 270. The waterproof layer 240 is made of material such as a thin layer of leakproof plastic in which water and moisture cannot pass through.

Figure 12:
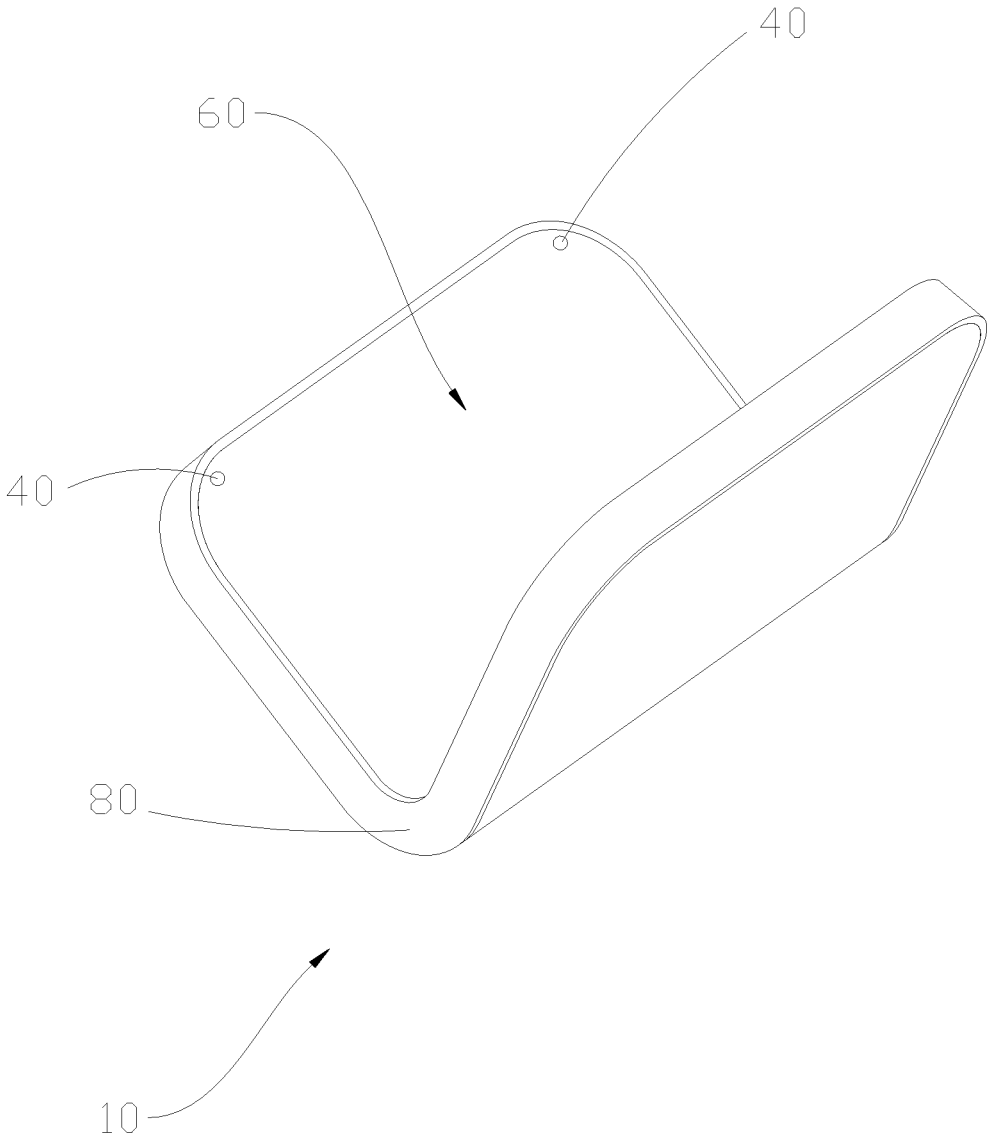
FIG. 12 is a perspective view of the moisture retaining pocket towel according to the second embodiment of the present invention.

Referring to FIG. 12 of the drawings, a perspective view of the moisture retaining pocket towel 10 according to the second embodiment of the present invention is illustrated. Broadly, the moisture retaining pocket towel 10 comprises a moisture retaining mechanism 60, an outside rim 80, and at least one pair of magnetic elements 40 in opposite polarity to each other.

Figure 13:
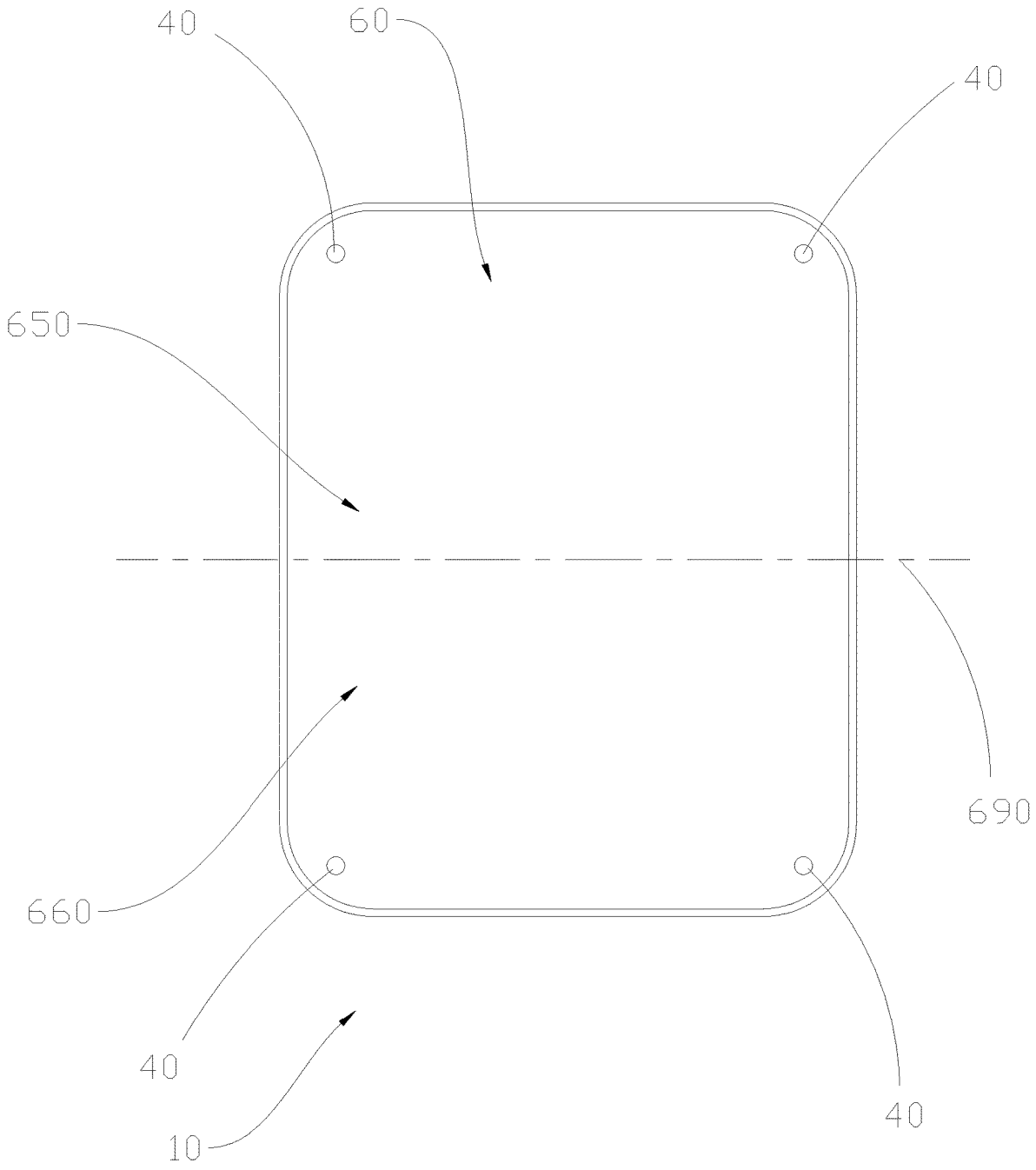
FIG. 13 is top view of the moisture retaining pocket towel in actuating position according to the second embodiment of the present invention.
Figure 14:
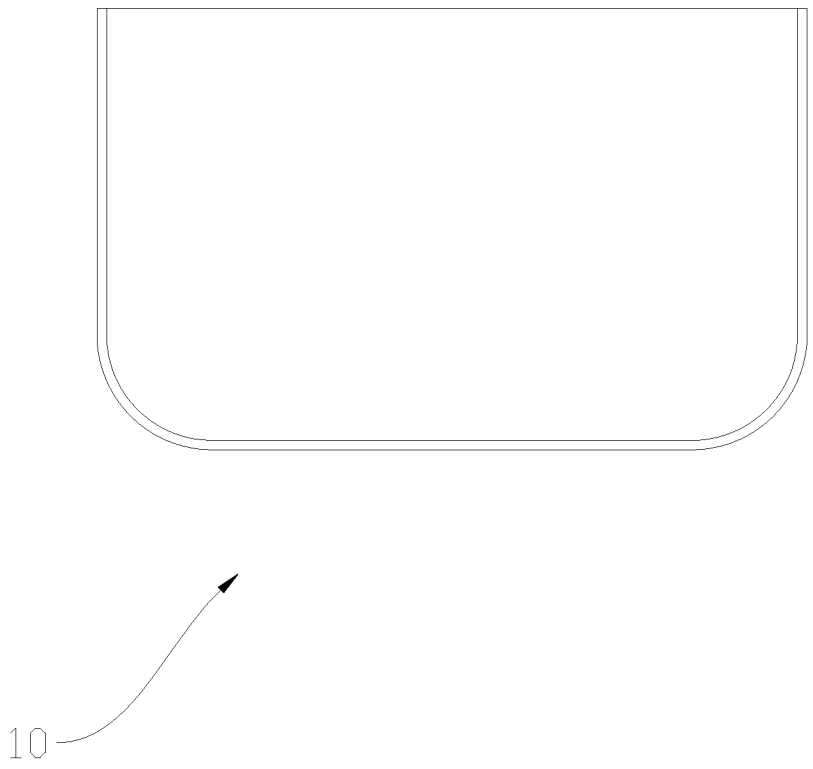
FIG. 14 is top view of the moisture retaining pocket towel in folding position according to the second embodiment of the present invention.

Referring to FIGS. 13 and 14 of the drawings, top views of the moisture retaining pocket towel 10 in actuating position and folding position are illustrated respectively according to the second embodiment of the present invention. Referring to FIG. 13 of the drawings, the moisture retaining mechanism 60 is divided into a first half portion 650 and a second half portion 660 by a centerline 690. The moisture retaining mechanism 60 is foldable in half and is capable to move between a folding position and to unfold into an actuating position. Referring to FIG. 14 of the drawings, when the first half portion 650 is folded onto the second half portion 660 in complete contact with each other, the moisture retaining mechanism 60 is in folding position.

As soon as the first half portion 650 or the second half portion 660 leaves contact with each other, the moisture retaining mechanism 60 is in actuating position. According to the second embodiment of the present invention, the moisture retaining mechanism 60 can unfold as a flat sheet as shown in FIG. 13 of the drawings.

Referring to FIG. 13 of the drawings, two pairs of magnetic elements 40 are provided on the moisture retaining mechanism 60 for illustration purpose. Each pair of magnetic elements 40 provides an attracting force to each other as they are in opposite polarity when they are in proximity to each other. When the moisture retaining mechanism 60 is in folding position, magnetic elements 40 placed on the moisture retaining mechanism 60 would offer the most direct attractive forces between each pair of magnet element 40. Referring to FIG. 13 of the drawings, the pair of the magnetic elements 40 are circular in shapes. Since the first half portion 650 must be in symmetry with the second half portion 660, the location for each pair of magnetic elements 40 must be also in symmetry manner. As an alternative, the shapes of the magnetic elements 40 may also be rectangular in shapes placed on the moisture retaining mechanism 60.

Figure 15:
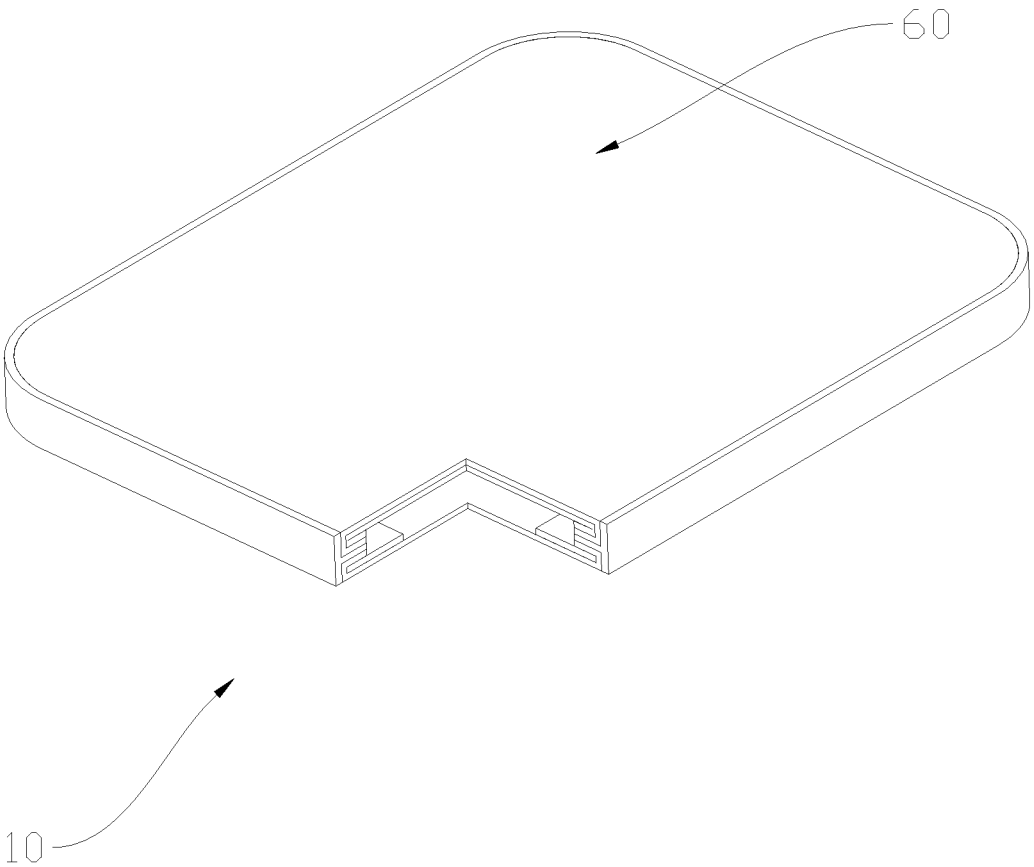
FIG. 15 is a perspective view of the moisture retaining pocket towel in actuating position with a cut away section for illustrative purpose according to the second embodiment of the present invention.
Figure 16:
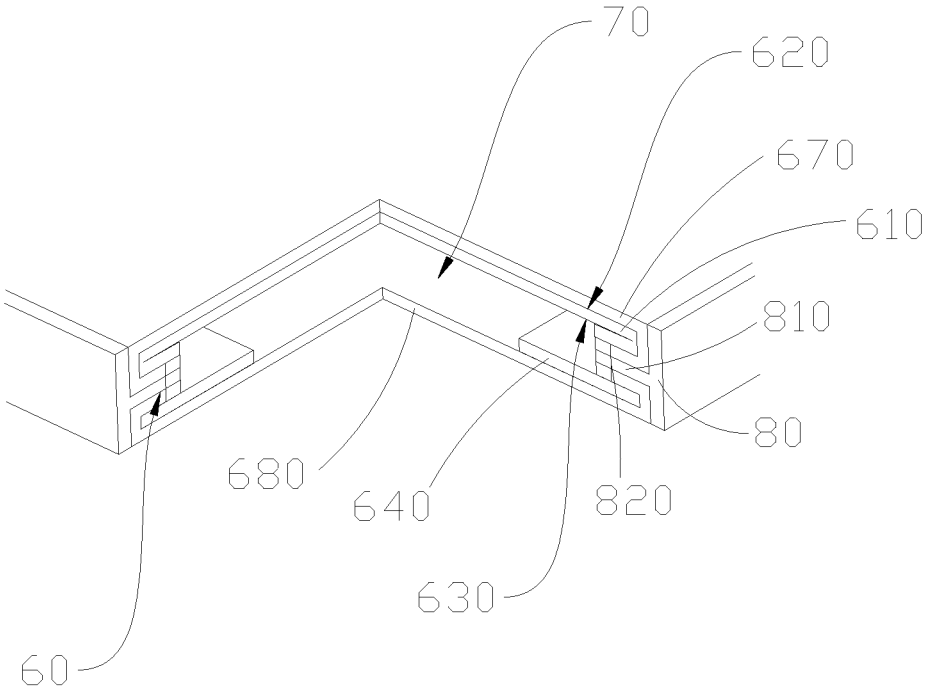
FIG. 16 is a magnified perspective view of the cut away section from FIG. 15 for illustrative purpose according to the second embodiment of the present invention.

Referring to FIG. 15 of the drawings, a perspective view of the moisture retaining pocket towel 10 in actuating position with a cut away section for illustrative purpose according to the second embodiment is shown. FIG. 16 is a magnified perspective view of the cut away section from FIG. 15 according to the second embodiment of the present invention. As shown in FIG. 16, the moisture retaining mechanism 60 comprises a foam layer 610 which has a top surface 620 facing upward and a bottom surface 630 facing downward. The bottom surface 630 is on the opposite side of the top surface 620. The moisture retaining mechanism 60 further comprises a breathable outside layer 680 provided in a predetermined distance adjacent from the bottom surface 630 of the foam layer 610. A breathable cavity 70 is formed between the foam layer 610 and the breathable outside layer 680. The outside rim 80 seals around the perimeter of the breathable cavity 70 so that moisture cannot be leaked through the breathable cavity 70. According to the second embodiment of the present invention, the moisture retaining mechanism 60 further comprises an absorbing layer 670 provided on the top surface 620. The absorbing layer wraps 670 around the foam layer 610 near the outside rim 80. The moisture retaining mechanism 60 further comprises a waterproof rim 640 being inserted in the breathable cavity 70 and is provided at a perimeter beneath the breathable outside layer 680. The breathable outside layer 680 wraps around the waterproof rim 640 near the outside rim 80. According to the second embodiment as shown in FIG. 16 of the drawings, the outside rim 80 further comprises an extended thin portion 810 forming a T shape. The extended thin portion 810 is provided between the absorbing layer 670 which wraps around the foam layer 610 and the breathable outside layer 680 which wraps around the waterproof rim 640. According to the second embodiment of the present invention, the addition of the waterproof rim 640, the extended thin portion 810, and the wrap around of the absorbing layer 670 and breathable outside layer 680 helps to extend the height of the breathable cavity 70.

According to the second embodiment of the present invention, the absorbing layer 670 is made of cloth which may absorb water and moisture efficiently. The foam layer 610 is made of memory foam. The preferred thickness of the memory foam is 3-5 mm. Memory foam absorbs and retains moisture as well. Other similar textile material may also be used as long as it can perform similar functions like the memory foam. In addition, memory foam forms a foundation for the moisture retaining layer 60 such that it can be folded in half easily and yet it can provide a firm support to the absorbing layer 670. The waterproof rim 640 can be made of material such as a thin layer of leakproof plastic in which the water and moisture cannot pass through. The breathable outside layer 680 is made from breathable textile with water resistance property. The choice of this material offers breathability to the breathable cavity 70 through the breathable outside layer 680. Therefore, once the foam layer 610 and absorbing layer 670 are soaked with moisture, the breathable cavity 70 can act as a medium to separate moisture from getting to the breathable outside layer 680. In addition, the breathable cavity 70 allows air to travel through the breathable outside layer 680 to reach the bottom surface 630 of the foam layer 610 for hygienic purpose. The outside rim 80 are made from various kind of fabrics.

Referring to FIG. 16 of the drawings, the outside rim 80 is being reinforced by a stitching 820 which passes through the absorbing layer 670 which wraps around the foam layer 610, the extended thin portion 810 of the outside rim 80 and the breathable outside layer 680 which wraps around the waterproof rim 640. In addition, adhesive glues may also be added to completely seal the outside rim 30 such that moisture and water cannot leaked to the outside.

Figure 17:
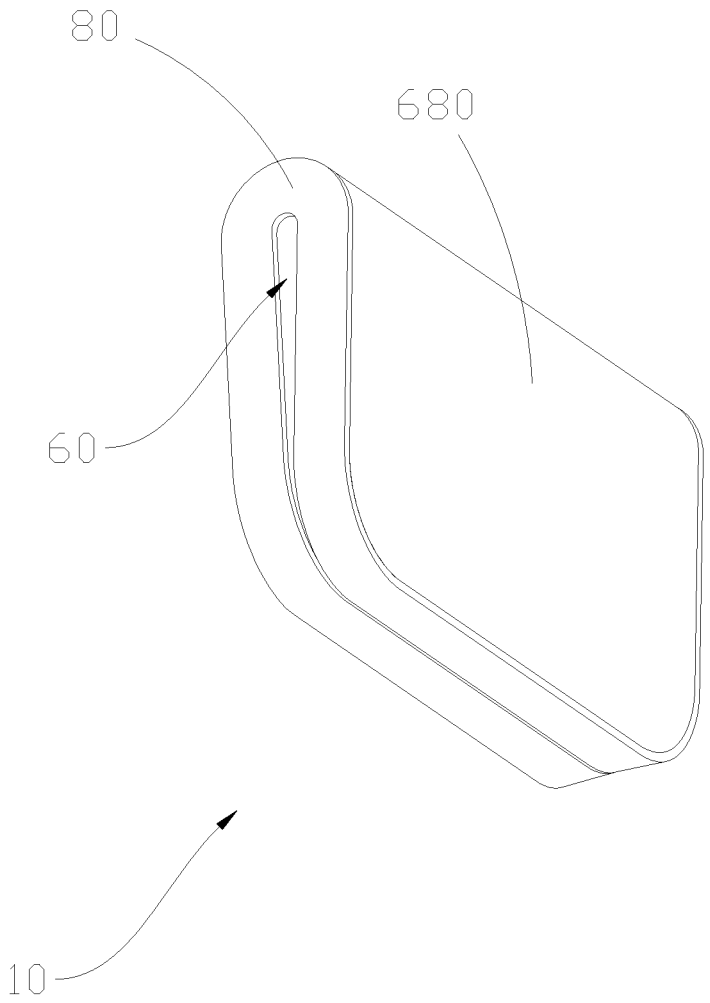
FIG. 17 is a perspective view of the moisture retaining pocket towel in folding position according to the second embodiment of the present invention.
Figure 18:
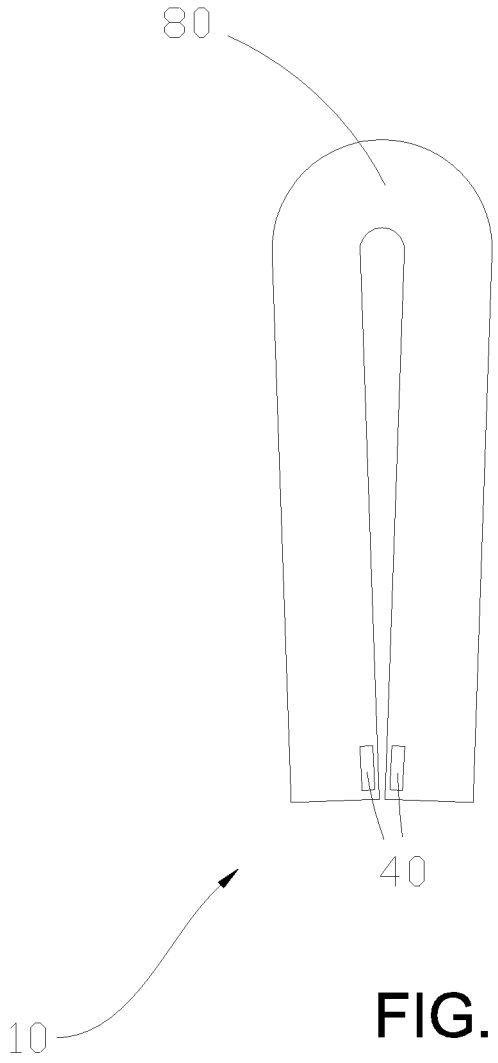
FIG. 18 is a side view of the moisture retaining pocket towel in folding position according to the second embodiment of the present invention.

Referring to FIG. 17 and FIG. 18 of the drawings, a perspective view and a side view of the moisture retaining pocket towel 10 in folding position according to the second embodiment of the present invention are illustrated. Once the moisture retaining mechanism 60 is folded in half, the magnetic elements 40 will retain the folding position as the pair of magnets will attract each other. Once the moisture retaining pocket towel 10 is in folding position, the outside rim 80 will seal off the moisture retaining layer 60 so that its exposure to the outside environment is reduced for retaining moisture. The slight exposure is an intended design since it helps to increase the level of breathability for the moisture retaining mechanism 60 for hygiene purpose.

Figure 19:
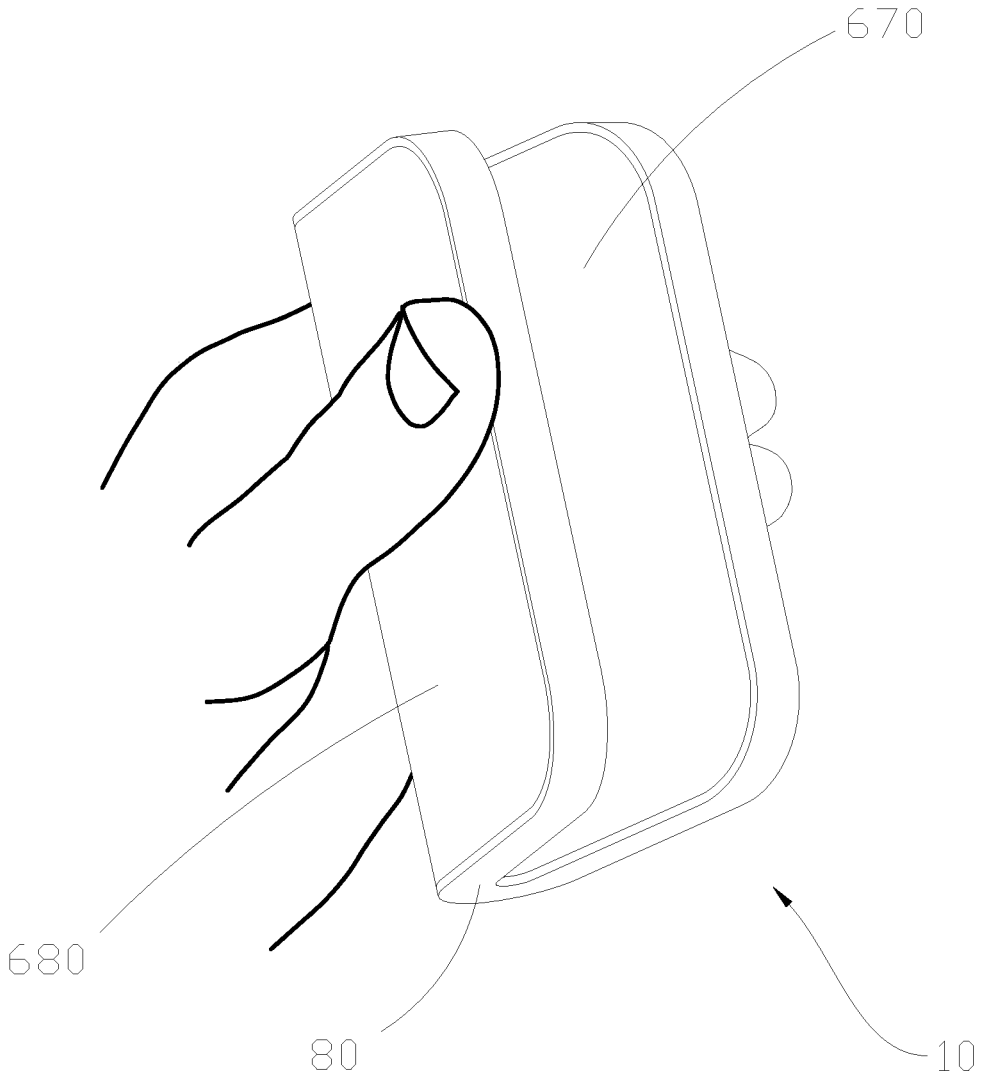
FIG. 19 is a perspective view of the moisture retaining pocket towel in actuating position while being operated by a user according to the second embodiment of the present invention.

Referring to FIG. 19 of the drawings illustrates a perspective view of the moisture retaining pocket towel 10 in actuating position while being operated by a user according to the second embodiment of the present invention. When using the moisture retaining pocket towel 10, the user can soak the absorbing layer 670 and the foam layer 610 with water. Afterward, the user can dry the excessive moisture and water off the outside rim 80 and the breathable outside layer 680. The second embodiment of the present invention works in a similar manner as the preferred embodiment of the present invention. The design of the second embodiment offers a better breathability to the moisture retaining mechanism 60 by utilizing the breathable cavity 70, the foam layer 610 and then breathable outside layer 680.

As mentioned above in the descriptions of related arts, different types of towel are needed for different usage and applications. The first embodiment of the present invention serves more as a towel which can remain moist throughout a day full day for cleaning articles. The second embodiment of the present invention is more for personal hygienic uses as its design offers more breathability to the wet layers while the overall design can still retain moisture for long hours. It is important to note that the user can use the present invention as a dry towel also for the purpose of absorbing moisture such as wiping moisture off a wet article or absorbing sweat for personal hygiene. After usage, the present invention can be dryly stored in a user's pocket or bag without leaking moisture to the environment.

The present invention, while illustrated and described in terms of different preferred embodiments, is not limited to the particular description contained in this specification. Additional alternative or equivalent components could also be used to practice the present invention.

What is claimed is:

1. A moisture retaining pocket towel, comprising:

a water retaining mechanism comprising a base layer having a front surface and a rear surface, an absorbing layer provided on said front surface of said base layer, and an outer layer provided on said rear surface of said base layer, wherein said water retaining mechanism is divided into a first half portion and a second half portion and is foldable in half to move between a folding position and an actuating position;

an outer rim divided into an upper portion rim and a lower portion rim encasing around an outer edge of said water retaining mechanism forming a water retaining peripheral; and at least one pair of magnetic elements in opposite polarity provided at said outer rim;

wherein in said folding position, said water retaining mechanism is folded in half and the exposure of said absorbing layer to the outside environment is minimized for retaining moisture, said magnetic elements pair with each other to retain said folding position, wherein in said actuating position, said magnetic elements unpair with each other such that said absorbing layer is unfolded for usage.

2. The moisture retaining pocket towel, as recited in claim 1, wherein said outer rim is made of material with predetermined softness, said water retaining peripheral has a predetermined thickness and width.

3. The moisture retaining pocket towel, as recited in claim 2, wherein said outer rim is made of soft PU leather, and said thickness and said width of said water retaining peripheral are 5-7 mm and 10-12 mm respectively.

4. The moisture retaining pocket towel, as recited in claim 3, wherein said water retaining mechanism further comprises an auxiliary waterproof layer provided in between said outer layer and said lower portion rim, said lower portion rim wraps around said auxiliary waterproof layer.

5. The moisture retaining pocket towel, as recited in claim 4, wherein said outer rim is being reinforced around the outer edge of said water retaining mechanism by an upper inner stitching, a lower inner stitching and an outer stitching.

6. The moisture retaining pocket towel, as recited in claim 5, wherein said upper inner stitching joins and passes through said upper portion rim and said absorbing layer;

said lower inner stitching joins and passes through said outer layer, said auxiliary waterproof layer and said lower portion rim; and said outer stitching joins and passes through said upper portion rim, said outer layer, said auxiliary waterproof layer, and said lower portion rim.

7. The moisture retaining pocket towel, as recited in claim 4, wherein said water retaining mechanism further comprises a waterproof layer provided between said absorbing layer and said base layer.

8. The moisture retaining pocket towel, as recited in claim 7, wherein the surface area of said waterproof layer is larger than the surface area of said absorbing layer.

9. The moisture retaining pocket towel, as recited in claim 8, wherein said outer rim is being reinforced around the outer edge of said water retaining mechanism by an upper inner stitching, a lower inner stitching and an outer stitching.

10. The moisture retaining pocket towel, as recited in claim 9, wherein said upper inner stitching joins and passes through said upper portion rim and said absorbing layer;

said lower inner stitching joins and passes through said outer layer, said auxiliary waterproof layer and said lower portion rim; and said outer stitching joins and passes through said upper portion rim, said waterproof layer, said outer layer, said auxiliary waterproof layer, and said lower portion rim.

11. The moisture retaining pocket towel, as recited in claim 10, wherein said at least one pair of magnetic elements are provided at said upper portion rim.

12. The moisture retaining pocket towel, as recited in claim 11, wherein said pairs of magnetic elements are circular or rectangular in shapes.

13. A moisture retaining pocket towel, comprising:

a moisture retaining mechanism comprising a foam layer having a top surface and a bottom surface and a breathable outside layer provided in a distance adjacent from said bottom surface of said foam layer forming a breathable cavity between said foam layer and said breathable outside layer, wherein said moisture retaining mechanism is divided into a first half portion and a second half portion and is foldable in half to move between a folding position and an actuating position;

an outside rim sealing around the perimeter of said breathable cavity; and at least one pair of magnetic elements in opposite polarity provided on said first half portion and said second half portion of said top side of said foam layer;

wherein in said folding position, said foam layer is folded in half such that the exposure to the outside environment is reduced for retaining moisture, said magnetic elements pair with each other to retain said folding position, wherein in said actuating position, said magnetic elements unpair with each other such that said foam layer is unfolded for usage.

14. The moisture retaining pocket towel, as recited in claim 13, wherein said moisture retaining mechanism further comprises a waterproof rim being inserted in said breathable cavity provided at a perimeter beneath said breathable outside layer.

15. The moisture retaining pocket towel, as recited in claim 14, wherein said breathable outside layer wraps around said waterproof rim near said outside rim.

16. The moisture retaining pocket towel, as recited in claim 15, wherein said moisture retaining mechanism further comprises an absorbing layer provided on said top surface of said foam layer.

17. The moisture retaining pocket towel, as recited in claim 16, wherein said absorbing layer wraps around said foam layer near said outside rim.

18. The moisture retaining pocket towel, as recited in claim 17, wherein said outside rim further comprises an extended thin portion to be inserted between said absorbing layer which wraps around said foam layer and said breathable outside layer which wraps around said waterproof rim.

19. The moisture retaining pocket towel, as recited in claim 18, wherein said outside rim is being reinforced by a stitching which joins and passes through said absorbing layer which wraps around said foam layer, said extended thin portion of said outside rim and said breathable outside layer which wraps around said waterproof rim.

20. The moisture retaining pocket towel, as recited in claim 19, wherein said pairs of magnetic elements are circular or rectangular in shapes.

* * * * *